US008847836B2

(12) United States Patent
Yu et al.

(10) Patent No.: US 8,847,836 B2
(45) Date of Patent: Sep. 30, 2014

(54) ANTENNA STRUCTURE AND MULTI-BEAM ANTENNA ARRAY USING THE SAME

(75) Inventors: Ya Chung Yu, Chiayi (TW); Chin Chung Nien, Hsinchu (TW); Jenn Hwan Tarng, Hsinchu (TW); Jun Yen Huang, Beigang Township, Yunlin County (TW); Chen Ming Li, Bade (TW); Li Yuan Chang, Taipei (TW)

(73) Assignee: Industrial Technology Research Institute, Chutung, Hsinchu (TW)

( * ) Notice: Subject to any disclaimer, the term of this patent is extended or adjusted under 35 U.S.C. 154(b) by 772 days.

(21) Appl. No.: 13/105,211

(22) Filed: May 11, 2011

(65) Prior Publication Data

US 2012/0139805 A1 Jun. 7, 2012

(30) Foreign Application Priority Data

Dec. 3, 2010 (TW) ..... 99142044 A

(51) Int. Cl.

| | |
|---|---|
| ***H01Q 13/10*** | (2006.01) |
| ***H01Q 21/08*** | (2006.01) |
| ***H01Q 9/42*** | (2006.01) |
| ***H01Q 19/06*** | (2006.01) |

(52) U.S. Cl.

CPC ..... *H01Q 21/08* (2013.01); *H01Q 9/42* (2013.01); *H01Q 19/06* (2013.01); *H01Q 13/10* (2013.01)

USPC ..... 343/770; 343/767; 343/769

(58) Field of Classification Search

USPC ..... 343/770, 767, 769, 838

See application file for complete search history.

(56) References Cited

U.S. PATENT DOCUMENTS

| | | | | |
|---|---|---|---|---|
| 6,075,493 | A | 6/2000 | Sugawara et al. | |
| 6,130,648 | A * | 10/2000 | Rulf et al. | 343/770 |
| 6,741,218 | B2 * | 5/2004 | Cavelier et al. | 343/779 |
| 7,057,569 | B2 * | 6/2006 | Isoifovich et al. | 343/770 |
| 7,358,913 | B2 | 4/2008 | Ebling et al. | |
| 7,629,936 | B2 | 12/2009 | Mizuno et al. | |
| 7,679,574 | B1 | 3/2010 | Horner | |
| 2006/0267830 | A1 | 11/2006 | O'Boyle | |
| 2007/0195004 | A1 | 8/2007 | Rebeiz et al. | |
| 2008/0023632 | A1 | 1/2008 | Ridgway et al. | |
| 2008/0211726 | A1 | 9/2008 | Elsallal et al. | |
| 2013/0285865 | A1 * | 10/2013 | Lo Hine Tong et al. | 343/767 |

FOREIGN PATENT DOCUMENTS

CN 201345417 Y 11/2009

OTHER PUBLICATIONS

Office Action issued from the State Intellectual Property Office of China (SIPO) on Jul. 25, 2013.

English translation of Office Action issued from the State Intellectual Property Office of China (SIPO) on Jul. 25, 2013.

Satoru Sugawara et al., "A MM-Wave Tapered Slot Antenna With Improved Radiation Pattern" IEEE MTT-S Digest 1997, p. 959-962.

* cited by examiner

*Primary Examiner* — Ahsik Kim

(74) *Attorney, Agent, or Firm* — Egbert Law Offices, PLLC

(57) ABSTRACT

An antenna structure comprises a substrate, a first antenna unit and a second antenna unit. The substrate comprises a first surface and a second surface opposing the first surface. The first antenna unit is disposed on the first surface, and comprises at least a first slot with a wider inside and narrower outside at the edge of the first antenna unit. The second antenna unit is disposed on the second surface, and is connected to the first antenna unit through a hole in the substrate. The radius of the at least one first slot is one-fourth the wavelength of the central frequency of the antenna structure.

20 Claims, 6 Drawing Sheets

ANTENNA STRUCTURE AND MULTI-BEAM ANTENNA ARRAY USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The disclosure is related to an antenna structure.

2. Description of Related Art Including Information Disclosed Under 37 CFR 1.97 and 37 CFR 1.98

An antenna array is composed of a plurality of isotropic radiators. Amplitude and phase difference of radiation are caused by a current flowing through the antenna array. An antenna array exhibits better controllability than a single antenna. Therefore, antenna arrays are suitable for many applications.

For example, a multi-beam antenna array is often used in near-field microwave imaging applications. In the near-field microwave imaging applications, the radiated electromagnetic wave is in a spherical wave and is focused through a lens on a focus plane of an antenna array. To generate an image of larger size, the required curvature of the focus plane becomes greater. Accordingly, the receiving antenna array on the focus plane is required to be rotated to match the adjusted curvature. However, if the focus plane is rotated, not only do the radiation patterns of each array unit interfere with one another, but the layout of the transmission lines of the radio frequency circuit at the back end become extremely complicated, which results in reduced resolution and consumption of a great amount of energy.

Accordingly, there is a need to design an antenna structure which can be arranged as a multi-beam antenna array. The direction of the radiation beam of the antenna structure is configurable, and the noise of the operating frequency can be eliminated. The multi-beam antenna array does not need to be moved or rotated. In addition, the antenna structure can suppress side lobe level to maintain the spatial resolution of the lens.

BRIEF SUMMARY OF THE INVENTION

One embodiment discloses an antenna structure comprising a substrate, a first antenna unit and a second antenna unit. The substrate comprises a first surface and a second surface opposing the first surface. The first antenna unit is disposed on the first surface and comprises at least a first slot with a wider inside and narrower outside at the edge of the first antenna unit. The second antenna unit is disposed on the second surface and is connected to the first antenna unit through a hole in the substrate. The radius of the at least one first slot is one-fourth wavelength of the central frequency of the antenna structure.

Another embodiment discloses a multi-beam antenna array comprising a substrate and a plurality of antenna structures. The substrate comprises a first surface and a second surface opposing the first surface. The plurality of antenna structures are disposed on the substrate and arranged in an array, and each of the plurality of antenna structures comprises a first antenna unit and a second antenna unit. The first antenna unit is disposed on the first surface and comprises at least a first slot with a wider inside and narrower outside at the edge of the first antenna unit. The second antenna unit is disposed on the second surface and is connected to the first antenna unit through a hole in the substrate. The radius of the at least one first slot is one-fourth the wavelength of the central frequency of the antenna structure.

BRIEF DESCRIPTION OF THE SEVERAL VIEWS OF THE DRAWINGS

The accompanying drawings, which are incorporated in and constitute a part of this specification, illustrate embodiments of the disclosure and, together with the description, serve to explain the principles of the invention.

DETAILED DESCRIPTION OF THE INVENTION

Figure 1:
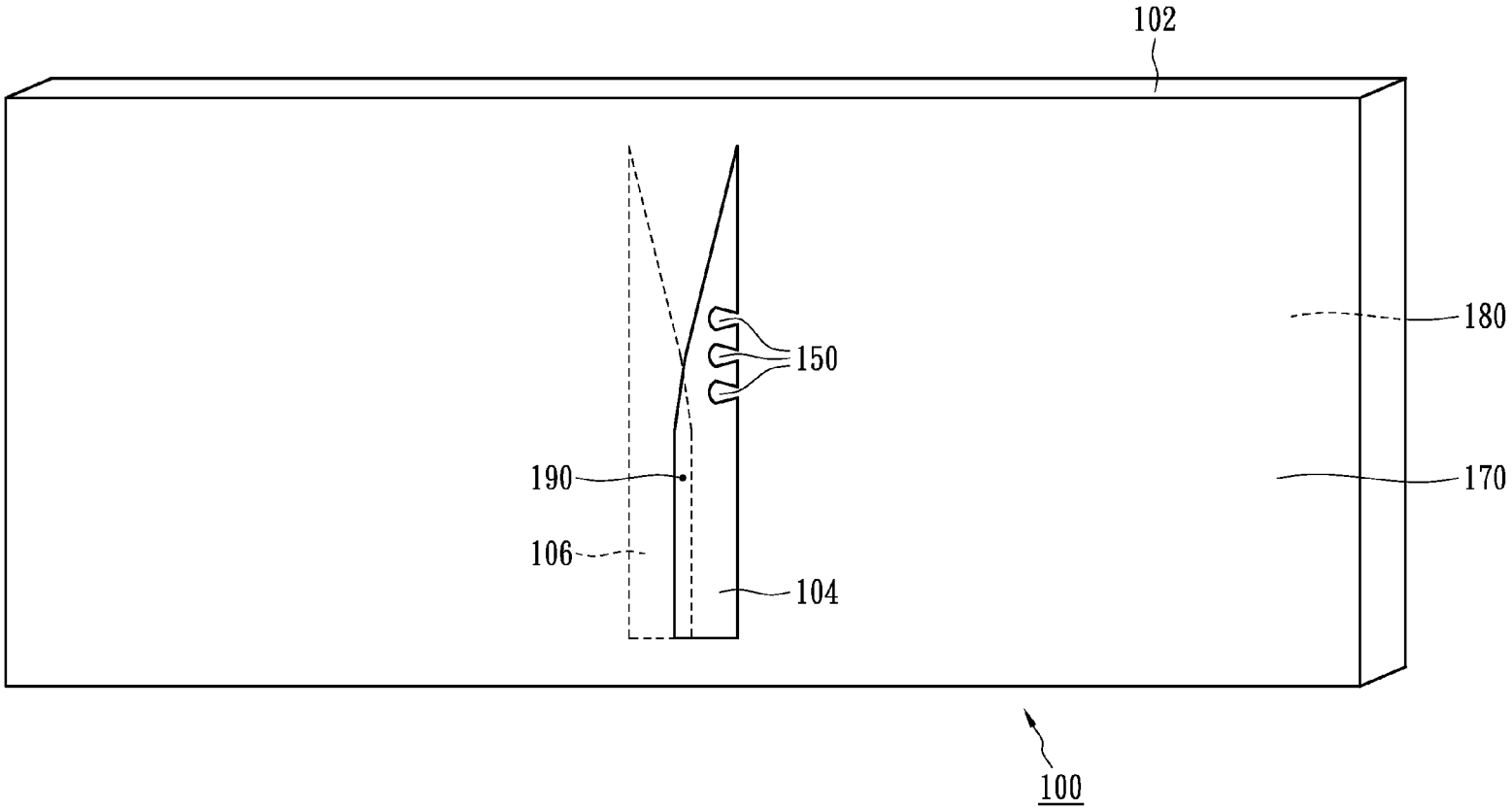
FIG. 1 shows a schematic view of an antenna structure according to an exemplary embodiment of this disclosure.

FIG. 1 shows a schematic view of an antenna structure according to an exemplary embodiment of this disclosure. As shown in FIG. 1, the antenna structure 100 comprises a substrate 102, a first antenna unit 104 and a second antenna unit 106. The substrate 102 comprises a first surface 170 and a second surface 180 opposing the first surface 170. The first antenna unit 104 is in a blade form with an edge facing outside. In addition, the first antenna unit 104 is disposed on the first surface 170 and comprises at least a first slot 150 with a wider inside and narrower outside at the edge of the first antenna unit 104. The second antenna unit 106 is in a blade form with an edge facing outside. In addition, the second antenna unit 106 is disposed on the second surface 180 and is connected to the first antenna unit 104 through a hole 190 in the substrate 102. The layout of the first antenna unit 104 and the second antenna unit 106 on the substrate 102 is symmetrical. In addition, the first antenna unit 104 is partially overlapped with the second antenna unit 106. As shown in FIG. 1, the arrangement of the first antenna unit 104 and the second antenna unit 106 forms a tapered slot antenna. It should be noted that the radius of the at least one first slot 150 is one-fourth the wavelength of the central frequency of the antenna structure 100.

Figure 2:
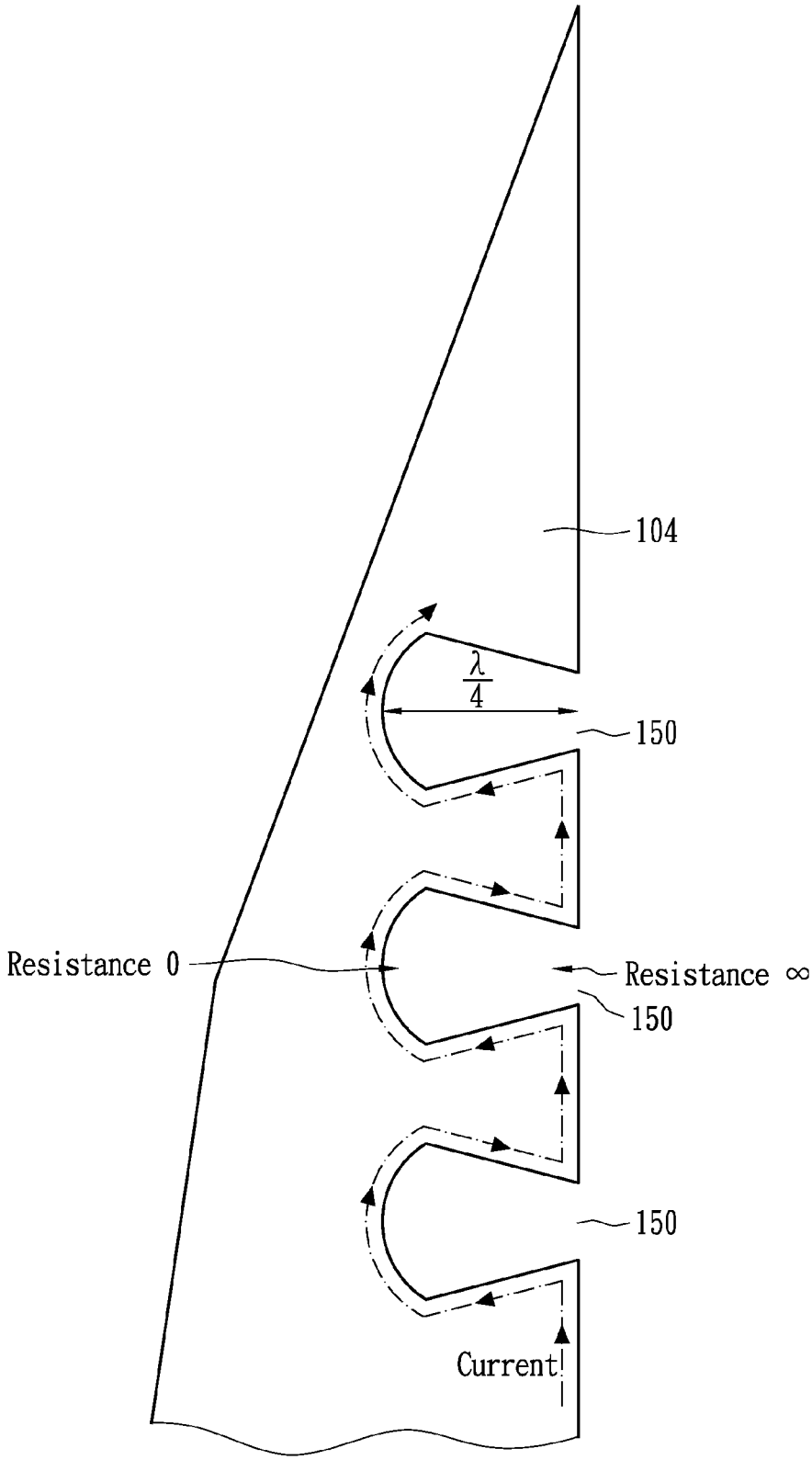
FIG. 2 shows a partially enlarged schematic view of an antenna structure according to an exemplary embodiment of this disclosure.

FIG. 2 shows a partially enlarged schematic view of the first antenna unit 104 shown in FIG. 1. As shown in FIG. 2, the first antenna unit 104 comprises three first slots 150, wherein the radius of each first slot 150 is one-fourth the wavelength of the central frequency of the antenna structure 100. The virtual center of each first slot 150 is located outside of the first antenna unit 104. In some embodiment of this disclosure, the fan angle of each first slot 150 is between 10 and 30 degrees. According to the impedance transformer principle, since the radius of each first slot 150 is one-fourth the wavelength of the central frequency of the antenna structure 100, the corresponding equivalent circuit acts as a closed circuit. In other words, the three first slots 150 act as closed circuits for the current flowing through the first antenna unit 104. Since a closed circuit draws currents, the current flowing through the first antenna unit 104 flows along the edges of the three first slots 150, as indicated by the arrow shown in FIG. 2. Referring to FIG. 1, since the second antenna unit 106 does not have such a slot, the length of the path the current flowing through the first antenna unit 104 is shorter than that of the current flowing through the second antenna unit 106. Therefore, the phase of the electromagnetic wave generated by the current flowing through the first antenna unit 104 falls behind that of the electromagnetic wave generated by the current flowing through the second antenna unit 106. Accordingly, the radiation pattern of the antenna structure 100 is changed.

Figure 3:
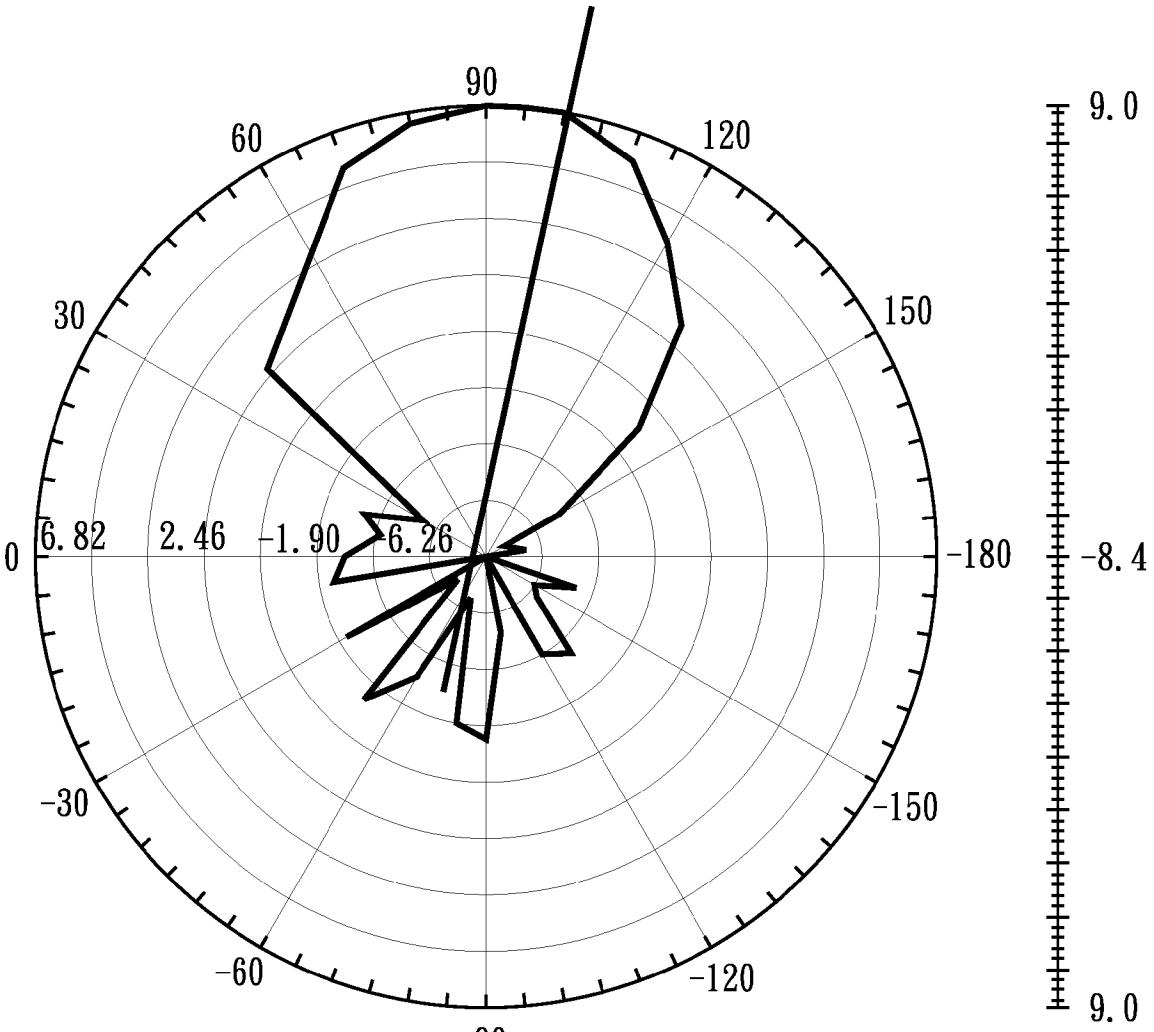
FIG. 3 shows a radiation pattern of an antenna structure according to an exemplary embodiment of this disclosure.

FIG. 3 shows the radiation pattern of the antenna structure 100. As shown in FIG. 3, since the phase of the electromagnetic wave generated by the current flowing through the first antenna unit 104 falls behind that of the electromagnetic wave generated by the current flowing through the second antenna unit 106, the radiation pattern of the antenna structure 100 rotates clockwise toward the first antenna unit 104.

Figure 4:
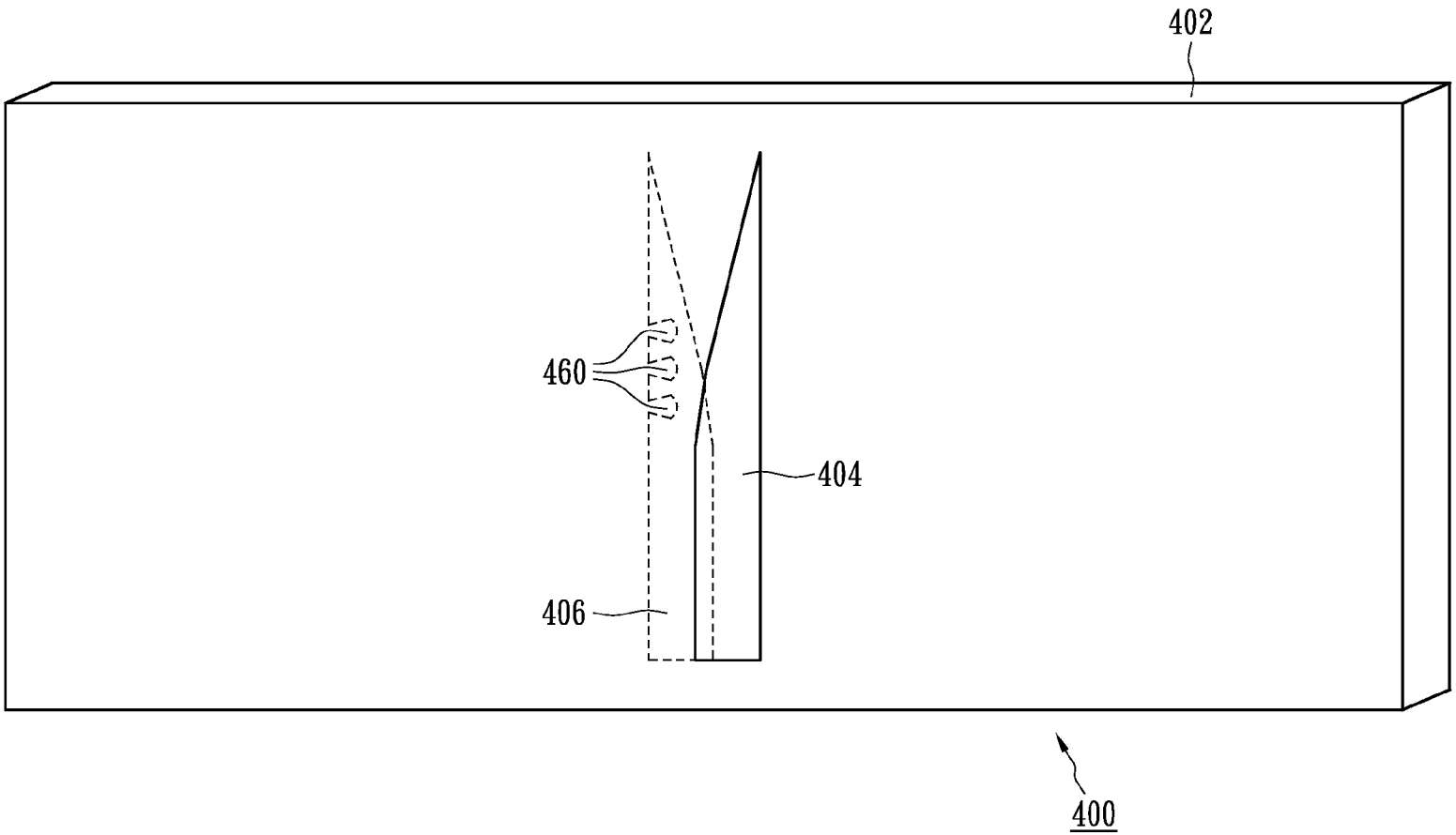
FIG. 4 shows a schematic view of an antenna structure according to another exemplary embodiment of this disclosure.

FIG. 4 shows a schematic view of an antenna structure according to another exemplary embodiment of this disclosure. As shown in FIG. 4, the antenna structure 400 comprises a substrate 402, a first antenna unit 404 and a second antenna unit 406. The antenna structure 400 is similar to the antenna structure 100 shown in FIG. 1, except the second antenna unit 406 comprises three second slots 460 and the first antenna unit 404 does not comprise any slot. Therefore, the phase of the electromagnetic wave generated by the current flowing through the first antenna unit 404 lies ahead of that of the electromagnetic wave generated by the current flowing through the second antenna unit 406.

Figure 5:
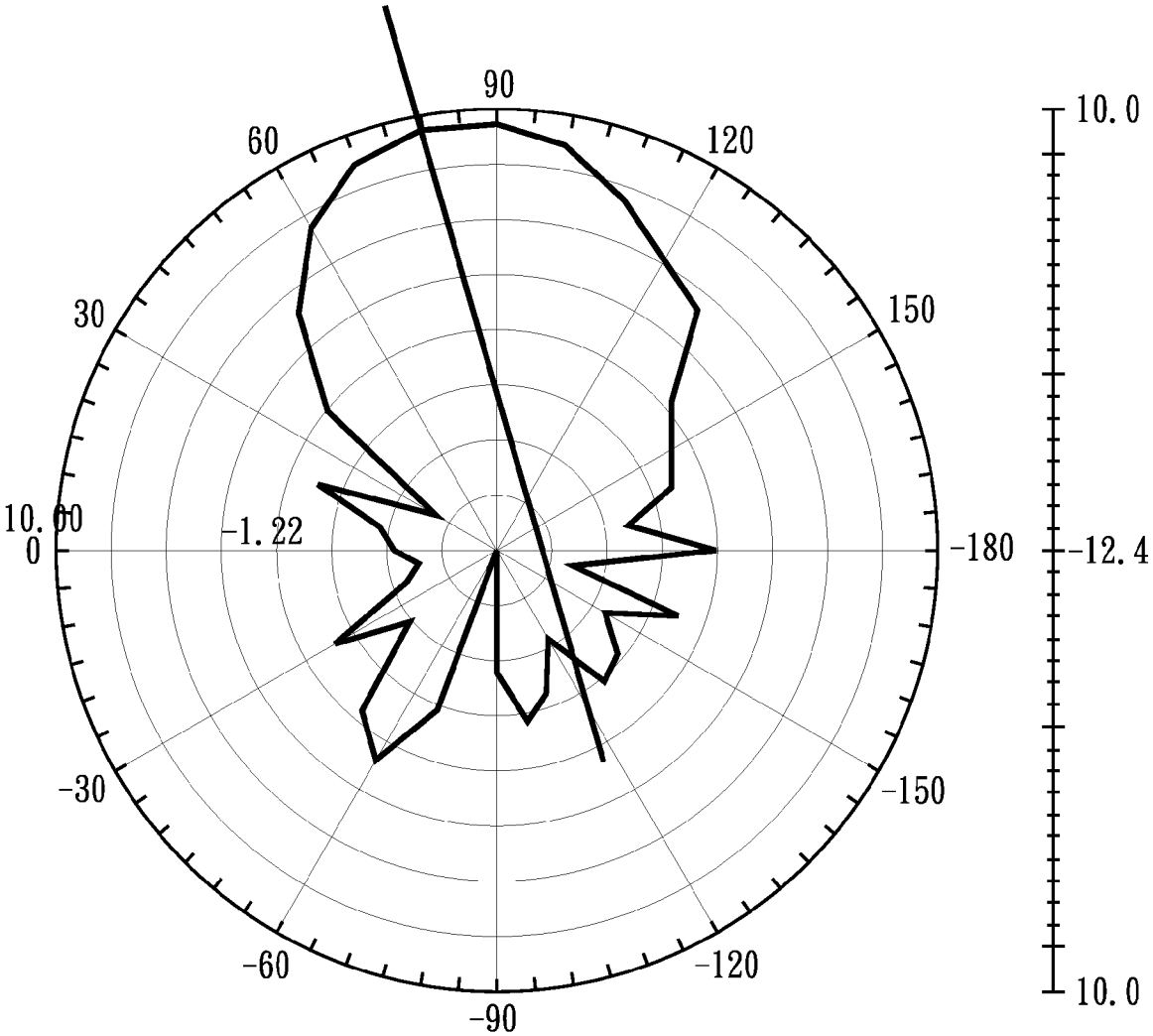
FIG. 5 shows a radiation pattern of an antenna structure according to another exemplary embodiment of this disclosure.

FIG. 5 shows the radiation pattern of the antenna structure 400. As shown in FIG. 5, since the phase of the electromagnetic wave generated by the current flowing through the first antenna unit 404 lies ahead of that of the electromagnetic wave generated by the current flowing through the second antenna unit 406, the radiation pattern of the antenna structure 400 rotates counterclockwise toward the second antenna unit 406.

Referring to the above exemplary embodiments, developers can increase or decrease the number of the first slots and the second slots to achieve the desired radiation pattern. The number of the first slots may be equal to or not equal to the number of the second slots. In addition, the number of the first slots and the second slots is not limited to three, but could include any quantity.

Referring to FIG. 2, according to the impedance transformer principle, the equivalent circuit of each first slot 150 viewed from the outside of the first antenna unit 104 is an open circuit. An open circuit exhibits features opposite to those of a closed circuit. That is, the electromagnetic wave of the operating frequency is less likely to be received by the first antenna unit 104 from the side comprising the first slots 150. Therefore, the first antenna unit 104 exhibits the capability to reject the noise of the operating frequency.

In near-field microwave imaging applications, spatial resolution is mostly determined by a lens antenna. If an image of large size is required, an antenna array is arranged at the focus plane of the lens. According to Snell's Law and Huygens' Principle, a high side lobe level of the radiation pattern affects the main lobe of the radiation pattern. Therefore, the radiation pattern on the focus plane is often required to be adjusted such that the radiation pattern after the lens maintains a low side lobe level. By combining the antenna structure of this disclosure, the radiation pattern of each antenna structure can be adjusted individually, and a lens antenna suitable for near-field microwave imaging applications can be achieved.

Figure 6:
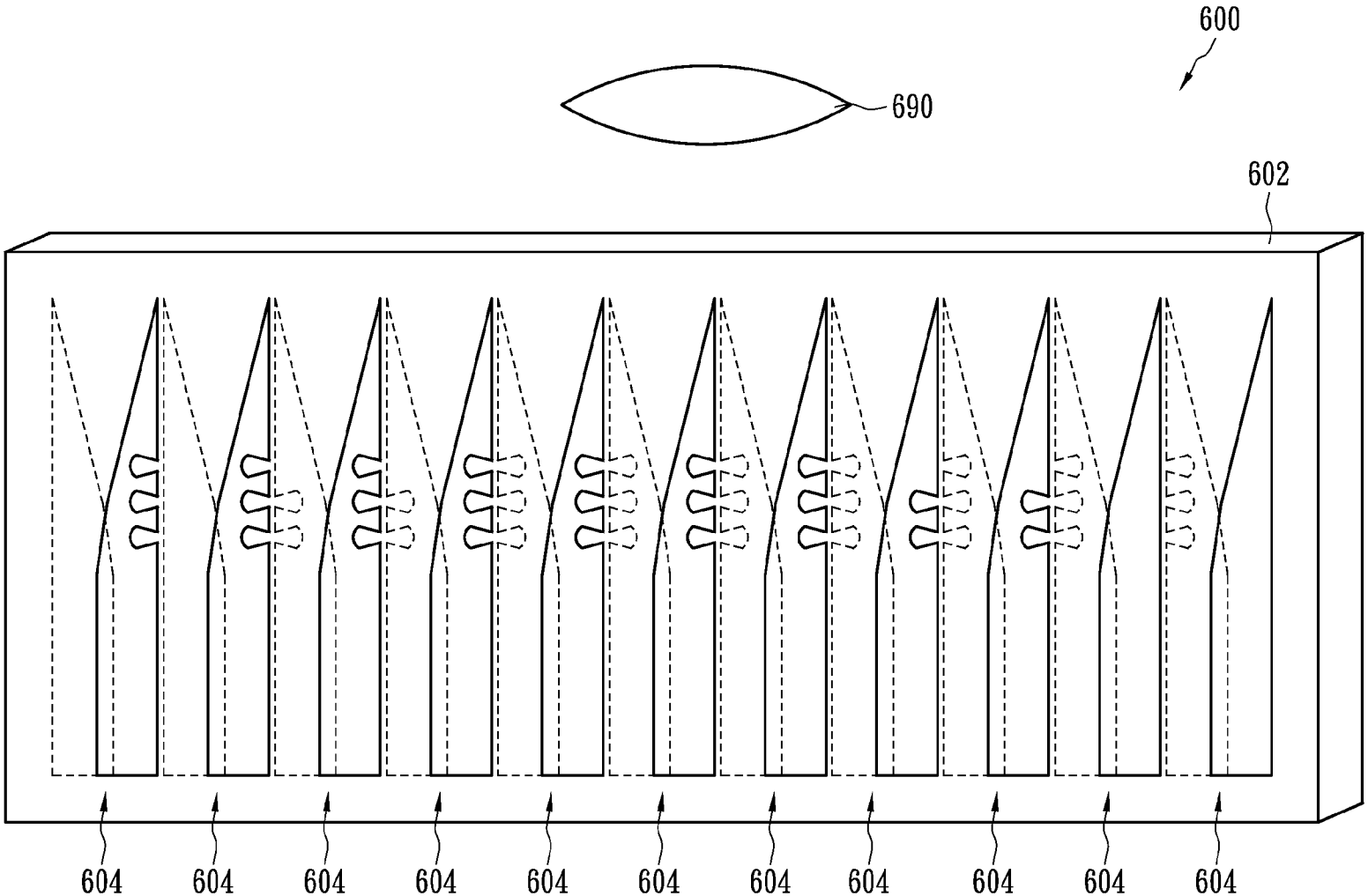
FIG. 6 shows a schematic view of a multi-beam antenna array according to an exemplary embodiment of this disclosure.

FIG. 6 shows a schematic view of a multi-beam antenna array according to an exemplary embodiment of this disclosure. As shown in FIG. 6, the multi-beam antenna array 600 comprises a substrate 602 and a plurality of antenna structures 604. Each antenna structure 604 is similar to the antenna structure 100 or the antenna structure 400 shown in FIGS. 1 and 4 respectively. As shown in FIG. 4, the number of first slots of the antenna structures 604 at the left side of the multi-beam antenna array 600 is greater than the number of second slots of the antenna structures 604 at the left side of the multi-beam antenna array 600. Conversely, the number of first slots of the antenna structures 604 at the right side of the multi-beam antenna array 600 is smaller than the number of second slots of the antenna structures 604 at the right side of the multi-beam antenna array 600. Accordingly, the radiation pattern of the antenna structures 604 at the left side of the multi-beam antenna array 600 points slightly to the right, the radiation pattern of the antenna structures 604 at the right side of the multi-beam antenna array 600 points slightly to the left, and the radiation pattern of the antenna structures 604 at the middle of the multi-beam antenna array 600 is not rotated. A lens 690 is arranged above the multi-beam antenna array 600. The layout of the multi-beam antenna array 600 is designed so that the radiation pattern thereof corresponds to the focus plane of the lens 690.

Referring to FIGS. 3 and 5, since the radiation patterns of the antenna structures 604 at both sides of the multi-beam antenna array 600 are not symmetric, the level of the side lobes of the radiation pattern after the lens 690 is low, and thus the spatial resolution of the lens 690 can be maintained at a suitable level. In addition, since the equivalent circuits of the first slots and the second slots viewed from the outside of the antenna unit 604 are open circuits, the coupling effect between each antenna unit 604 is reduced, and hence the isolation between array units is enhanced.

In conclusion, the antenna structures provided by this disclosure utilize slots such that the radiation patterns of the antenna structures are changed. By adjusting the number of slots, the amount of shifting of the radiation patterns of the antenna structures can be adjusted accordingly. Therefore, the multi-beam antenna array combining a plurality of antenna structures provided by this disclosure is suitable for near-field microwave imaging applications in that the antenna array does not need to be rotated.

The above-described exemplary embodiments are intended to be illustrative only. Those skilled in the art may devise numerous alternative embodiments without departing from the scope of the following claims.

We claim:

1. An antenna structure, comprising:

a substrate, comprising a first surface and a second surface opposing the first surface;

a first antenna unit, disposed on the first surface and comprising at least a first slot with a wider inside and narrower outside at the outer edge of the first antenna unit; and a second antenna unit, disposed on the second surface and connected to the first antenna unit through a hole on the substrate;

wherein the radius of the at least one first slot is one-fourth wavelength of the central frequency of the antenna structure.

2. The antenna structure of claim 1, wherein the second antenna unit comprises at least a second slot with a wider inside and narrower outside at the outer edge of the second antenna unit, and the radius of the at least one second slot is one-fourth the wavelength of the central frequency of the antenna structure.

3. The antenna structure of claim 2, wherein the number of first slots is not equal to the number of second slots.

4. The antenna structure of claim 2, wherein the number of first slots is equal to the number of second slots.

5. The antenna structure of claim 1, wherein the first antenna unit is in a blade form with a longer edge facing outside.

6. The antenna structure of claim 1, wherein the second antenna unit is in a blade form with a longer edge facing outside.

7. The antenna structure of claim 1, wherein the layout of the first antenna unit and the second antenna unit is symmetrical.

8. The antenna structure of claim 1, wherein the first antenna unit is partially overlapped with the second antenna unit.

9. The antenna structure of claim 1, wherein the arrangement of the first antenna unit and the second antenna unit forms a tapered slot antenna.

10. The antenna structure of claim 1, wherein the fan angle of the at least one first slot is between 10 and 30 degrees.

11. The antenna structure of claim 2, wherein the fan angle of the at least one second slot is between 10 and 30 degrees.

12. A multi-beam antenna array; comprising:

a substrate comprising a first surface and a second surface opposing the first surface; and a plurality of antenna structures; disposed on the substrate and arranged in an array;

wherein each of the plurality of antenna structures comprises:

a first antenna unit; disposed on the first surface and comprising at least a first slot with a wider inside and narrower outside at the outer edge of the first antenna unit; and a second antenna unit; disposed on the second surface and connected to the first antenna unit through a hole in the substrate;

wherein the radius of the at least one first slot is one-fourth the wavelength of the central frequency of the antenna structure.

13. The multi-beam antenna array of claim 12, wherein the second antenna unit comprises at least a second slot with a wider inside and narrower outside at the outer edge of the second antenna unit, and the radius of the at least one second slot is one-fourth the wavelength of the central frequency of the antenna structure.

14. The multi-beam antenna array of claim 12, wherein the first antenna unit is in a blade form with a longer edge facing outside.

15. The multi-beam antenna array of claim 12, wherein the second antenna unit is in a blade form with a longer edge facing outside.

16. The multi-beam antenna array of claim 12, wherein the arrangement of the first antenna unit and the second antenna unit is symmetrical.

17. The multi-beam antenna array of claim 12, wherein the first antenna unit and the second antenna unit are partially overlapped on the substrate.

18. The multi-beam antenna array of claim 12, wherein the fan angle of the at least one first slot is between 10 and 30 degrees.

19. The multi-beam antenna array of claim 13, wherein the fan angle of the at least one second slot is between 10 and 30 degrees.

20. The multi-beam antenna array of claim 12, wherein the arrangement of the first antenna unit and the second antenna unit forms a tapered slot antenna.

* * * * *